US007596899B1

(12) United States Patent
Michael et al.

(10) Patent No.: US 7,596,899 B1
(45) Date of Patent: Oct. 6, 2009

(54) FLEXIBLE RELEASABLY-MOUNTED DISPLAY DEVICE

(75) Inventors: Daryl A. Michael, Newton, IA (US); Jennifer L. Michael, Newton, IA (US)

(73) Assignee: Welshmark Industries Inc., Marion, IA (US)

( * ) Notice: Subject to any disclaimer, the term of this patent is extended or adjusted under 35 U.S.C. 154(b) by 0 days.

(21) Appl. No.: 10/950,846

(22) Filed: Sep. 27, 2004

(51) Int. Cl.
*G09F 1/08* (2006.01)

(52) U.S. Cl. ..... 40/594; 40/541; 428/7; 362/249.04

(58) Field of Classification Search ..... 40/594, 40/544, 543, 618; 428/7–11; 362/800–805, 362/249.04, 503, 145, 249.08, 278, 288, 362/320, 190–191, 396–398
See application file for complete search history.

(56) References Cited

U.S. PATENT DOCUMENTS 4,749,222 A * 6/1988 Idland ..... 296/152
4,962,602 A * 10/1990 Meyrowitsch ..... 40/541
5,471,773 A 12/1995 Hoffman
5,525,177 A * 6/1996 Ross ..... 156/240
5,533,289 A * 7/1996 Hoffman ..... 40/544
5,609,938 A 3/1997 Shields
5,830,529 A 11/1998 Ross
6,176,958 B1 * 1/2001 Shea ..... 156/253
6,258,200 B1 * 7/2001 Kassab ..... 156/273.1
6,672,748 B2 * 1/2004 Baldwin ..... 362/558
2005/0012003 A1 * 1/2005 Jackson et al. ..... 248/205.3
2006/0090384 A1 * 5/2006 Woodruff ..... 40/544
2006/0101685 A1 * 5/2006 Smith et al. ..... 40/556

* cited by examiner

*Primary Examiner*—Cassandra Davis
(74) *Attorney, Agent, or Firm*—McKee, Voorhees & Sease, P.L.C.

(57) ABSTRACT

A display device (11) having various discrete components (13-17) integrated upon a flexible substrate (12). One side of the flexible substrate (12) is used to mount the discrete components (13-17), while the remaining side of the flexible substrate (12) comprises a releasably-adherent surface (12*a*) that allows the display device (11) to be releasably mounted to an external receiving surface (10). The discrete components (13-17) have electrical, mechanical, graphical, and/or combinational properties that cooperate to provide a visual display. The visual display can be made viewable when looking toward the exterior side (10*a*) and/or interior side (10*b*) of the receiving surface (10). The display device (11) is ideally suited for business signs, residential signs, novelty signs, vehicle signs, advertisements, holiday decorations, and numerous other applications.

22 Claims, 5 Drawing Sheets

FLEXIBLE RELEASABLY-MOUNTED DISPLAY DEVICE

BACKGROUND OF THE INVENTION

1. Field of Invention

The present invention relates to releasably-mounted visual displays, and more particularly to a releasably-mounted display device having discrete electrical, mechanical, graphical, and/or combinational components integrated upon a flexible substrate.

2. Description of Prior Art

A number of releasably-mounted visual display devices are known in the prior art. These prior art devices are intended to be applied to a receiving surface, such as the window of a building or vehicle, and are used to display various visual images such as artwork, logos, stickers, and advertisements.

In U.S. Pat. No. 5,609,938, Shields describe a one-way vision display device that can be used to display various types of images, such as advertisements, on a transparent medium, such as the window of a building or vehicle. The device is sequentially comprised of an opaque back panel, an image panel having a light-reflective image applied, and a transparent front panel. The panels are made of flexible sheet material and are bonded together by adhesive layers. A plurality of holes extend through the panels and adhesive layers to allow the device to appear substantially transparent when looking toward the opaque back panel, such that the image is only viewable when looking toward the transparent front panel. The device is mounted to the window of a building or vehicle so that the image is viewable through the window. A pressure-sensitive adhering means is disposed on the outward surface of the transparent front panel to accomplish the mounting. In at least one embodiment, the pressure-sensitive adhering means comprises static-cling properties so that the device can be releasably mounted to a window.

In U.S. Pat. No. 6,258,200 B1, Kassab describes a static-cling sticker assembly that is releasably mounted to a receiving surface. The assembly is comprised of an indicia-bearing sticker that is adhered to one side of a static-cling film intermediary. The opposite side of the static-cling intermediary is a applied to the receiving surface so as to display the indicia-bearing sticker. In at least one embodiment, the assembly is used to releasably mount an indicia-bearing vehicle sticker to the interior side of a vehicle windshield, so that the indicia is viewable from the exterior side of the windshield. In other embodiments, the assembly is used to releasably mount an indicia-bearing sticker to a household appliance or window.

In U.S. Pat. No. 6,672,748 B2, Baldwin describes a back-lighted display unit capable of displaying various types of artwork, logos, messages, or pictures. The unit is sequentially comprised of a main back housing, a circuit board, a light source panel, a cover glass to which an image is applied, a front trim bezel, and a mounting feature to releasably attach the unit to a transparent structure such as a window or display case. The mounting feature is affixed to the outside perimeter of the unit's trim bezel and is comprised of either multiple suction cups, small pieces or a continuous gasket of double-sided-adhesive foam, or an adhesive-backed hook and loop product. In at least one embodiment, the unit's light source is powered by an external power source through an attached cord. In other embodiments, the light source is powered by an internal solar cell or internal batteries. When the light source is powered, the image applied to the cover glass is illuminated and viewable through the transparent structure to which the unit is releasably mounted.

Numerous disadvantages and limitations become apparent when considering the above prior art. The releasably-mounted display devices disclosed by Shields and Kassab are basically limited to displaying significantly flat images such as printed artwork, graphics, stickers, and the like. Although Shields further teaches that the image-reflective layer in one embodiment of his device may comprise a screen layer for reflecting externally projected images, the type of images displayed by the Shields and Kassab devices are considered to be internally passive. For example, the images displayed by their devices are viewable only in the presence of an external light source, in that no provisions are made for internal lighting. Furthermore, no provisions are made to provide internally electrified or mechanized operation to facilitate active image display.

The housing used by the device disclosed by Baldwin has front, rear, and side edges which define an open area within the housing, in which a circuit board, light source panel, and image cover glass are contained. This type of construction has the disadvantage of being substantially rigid, making it difficult to mount the device to curved or irregular shaped surfaces. The rigid nature of the housing would also make it difficult to handle, store, and ship larger versions of the device, putting limitations on the size of the device. The making of the housing itself would also require special tooling, such as that used for injection molding, which can result in expensive start-up costs. These expensive tooling costs can be further multiplied if any modifications to the housing are required.

Although the Baldwin device contains an internal light source to actively display the image, the light source panel extends across substantially the entire area of the housing and image cover glass, leaving no additional area for other image-generating components. The light source panel is dedicated to illuminating the entire image affixed to the cover glass. The type of image being displayed by the device would therefore be limited to substantially flat images such as printed artwork, graphics, stickers, logos, and the like, as in the case of the Shields and Kassab devices. Furthermore, similar to the Shields device, the image displayed by the Baldwin device is only viewable when looking toward the front surface of the device.

Baldwin differentiates his device from the relatively crowded art of illuminated displays by making it mountable to the interior of a window or other glass surface. There are several disadvantages, however, associated with the mounting feature of the device. For example, in the case of using the disclosed adhesive-backed hook and loop product for the releasable mounting feature, either the hook portion or the loop portion of the product will undesirably remain affixed to the receiving surface (window) after removing the display device. In the case of using the disclosed suction cups for the releasable mounting feature, it's common for suction cups to lose their holding grip on a receiving surface, especially when the receiving surface hasn't been thoroughly cleaned prior to installation. Suction cups can also leave unsightly marks on the receiving surface after being removed. In either case, since the window mounting feature of the Baldwin device is restricted to being placed on the outside perimeter of the front trim bezel, a limited amount of surface area is provided for mounting the device to the receiving surface. This limited amount of surface area limits the holding power of the mounting feature, which correspondingly puts limitations on the size and weight of the display device. This size limitation becomes evident in Baldwin's acknowledgment that the device would be used in applications where "a miniature back-lighted display is desired".

BRIEF SUMMARY OF THE INVENTION

The present invention is a releasably-mounted display device having discrete electrical, mechanical, graphical, and/or combinational components integrated upon a flexible substrate. One surface of the flexible substrate is used to mount the various discrete components associated with the device, while the remaining surface of the flexible substrate comprises releasable adhering properties that allow the device to be releasably mounted to a receiving surface such as glass, ceramic, metal, plastic, or other similar material. The various discrete components of the device have electrical, mechanical, graphical, and/or combinational properties that cooperate to produce a viewable display. The present invention can be used to display numerous types of passive and/or active images which, depending on the receiving surface, can be made viewable from various viewing directions. Applications ideally suited for the present invention would include business signs, residential signs, novelty signs, vehicle signs, advertisements, holiday decorations, and numerous other applications.

OBJECTS AND ADVANTAGES

Accordingly, in view of the disadvantages and limitations associated with the prior art, several objects and advantages of the present invention are:

(a) to provide a new and improved display device that can be releasably mounted to a receiving surface such as glass, ceramic, metal, plastic, or other similar material;

(b) to provide a releasably-mounted display device that comprises various discrete electrical, mechanical, graphical, and/or combinational components which cooperate to produce a viewable display;

(c) to provide a releasably-mounted display device that is constructed using a flexible substrate that not only allows the device to be mounted to irregular shaped receiving surfaces, but also allows the device to be rolled-up during handling, storage, and shipment;

(d) to provide a flexible releasably-mounted display device that comprises releasable adhering properties associated with substantially one side of its flexible substrate to provide a significant amount of surface area and increased holding power to securely mount the device to a receiving surface, while also allowing the device to be removed in its entirety from the receiving surface without leaving residual components, adhesives, or markings;

(e) to provide a flexible releasably-mounted display device that is capable of displaying a wide variety of passive and/or active images, ranging from conventional flat images to electrically and/or mechanically activated images that are substantially three-dimensional;

(f) to provide a flexible releasably-mounted display device that is capable of being powered and/or controlled by various internal and/or external sources;

(g) to provide a flexible releasably-mounted display device that is capable of displaying images that are viewable from various viewing directions, such as unidirectional and bi-directional images that can be viewed from the front and/or back surfaces of the device;

(h) to provide a flexible releasably-mounted display device that is not reasonably restricted in size and shape, and requires no expensive tooling costs to construct, in that it is not contained within a housing or frame;

(i) to provide a flexible releasably-mounted display device that is easily modifiable to fit a variety of applications, and is easily adaptable to incorporating discrete devices of the latest technology.

Further objects and advantages of the present invention will become apparent from the ensuing description and drawings.

BRIEF DESCRIPTION OF DRAWING FIGURES

REFERENCE NUMERALS IN DRAWINGS

Figure 1A:
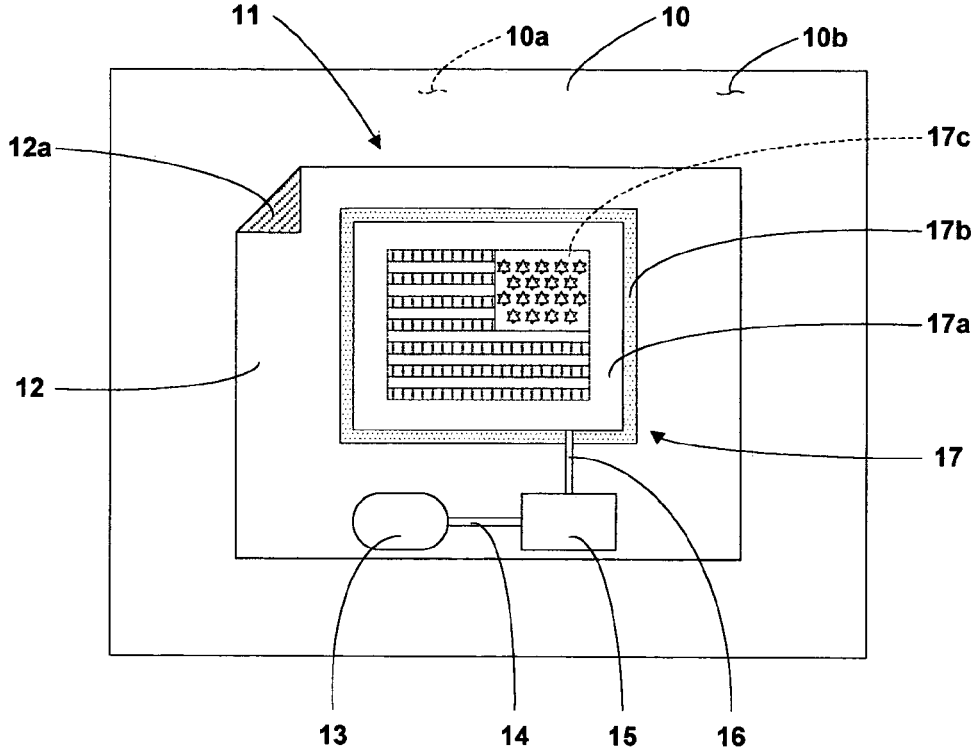
FIG. 1A shows the rear view of a general display device employing the principles of the present invention.

10 external receiving surface
10*a* exterior side of receiving surface
10*b* interior side of receiving surface
11 display device
12 flexible substrate
12*a* releasably-adherent surface
13 energy component
14 conducting component
15 control-circuit component
16 conducting component
17 image-generating component
17*a* exterior-facing illuminating component
17*b* exterior-facing graphical component
17*c* exterior-facing graphical image
17*a*' interior-facing illuminating component
17*b*' interior-facing graphical component
17*c*' interior-facing graphical image
18 interface component

DESCRIPTION OF THE PREFERRED EMBODIMENT

Referring to FIG. 1A, a display device 11 based on the general principles of the present invention is shown to be mounted to the interior side 10*b* of an external receiving surface 10. The display device 11 is shown to comprise a variety of discrete components 13-17 that are mounted upon one side of a flexible substrate 12. The opposite side of the flexible substrate 12 is shown to comprise a releasably-adherent surface 12*a* that allows the display device 11 to be releasably mounted to the receiving surface 10. The discrete components 13-17 are introduced to demonstrate the potential of the present invention, with the understanding that the actual type, location, and quantity of components can vary depending on the particular application. Furthermore, it should be understood that any or all of the discrete components 13-17 may be combined to form a combinational component. Accordingly, an energy component 13 is shown to be connected through a conducting component 14 to a control-circuit component 15. The control-circuit component 15 is shown to be connected through a conducting component 16 to an image-generating component 17. The image-generating component 17 is shown to be a combinational component that is comprised of both an exterior-facing illuminating component 17*a* and an exterior-facing graphical component 17*b*. For clarity the graphical component 17*b* is shown to be larger than the illuminating component 17*a*, when in actuality the graphical component 17*b* may be the same size or smaller than the illuminating component 17*a*. The graphical component 17*b* is shown to include an exterior-facing graphical image 17*c* that is oriented so as to be viewable when looking toward the exterior side 10*a* of the receiving surface 10 (through the receiving surface 10).

Figure 1B:
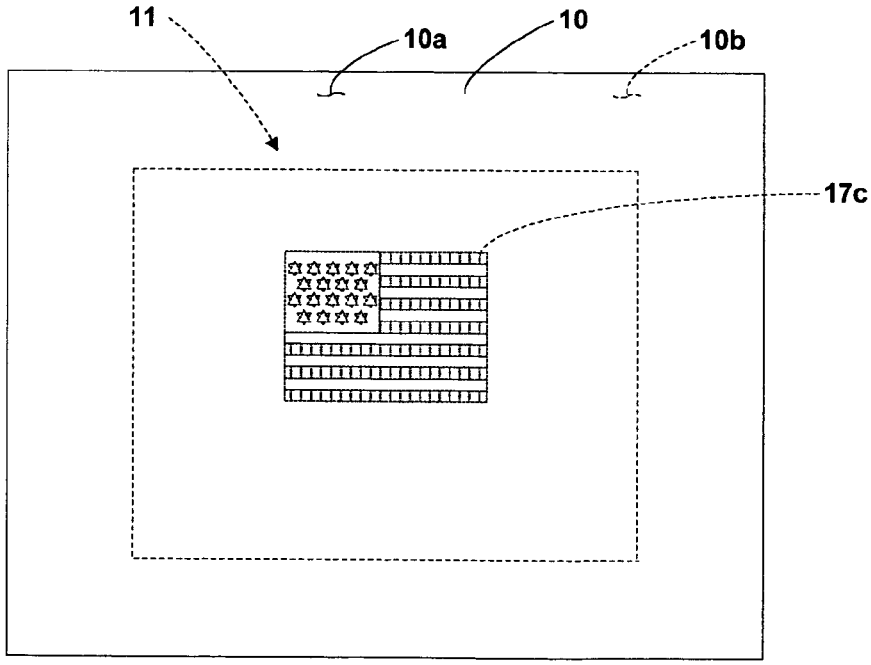
FIG. 1B shows the front view of the display device of FIG. 1A as viewed through a transparent receiving surface.

Referring to FIG. 1B, the graphical image 17*c* of the display device 11 of FIG. 1A is shown to be viewable when looking toward the exterior side 10*a* of the receiving surface (through the receiving surface 10), assuming that the portions of the receiving surface 10 and flexible substrate 12 that are coincident with the graphical image 17*c* are transparent.

Referring to the operation of the general display device 11 of FIGS. 1A and 1B, the energy component 13 would provide power through conducting component 14 to the control-circuit component 15. The control-circuit component 15 would then direct a modified or unmodified version of the power through conducting component 16 to the image-generating component 17. The power received by the image-generating component 17 would then activate the illuminating component 17*a* in order to correspondingly illuminate the graphical image 17*c* of the graphical component 17*b*. Assuming the display device 11 is mounted to a transparent receiving surface 10, such as the window of a building or vehicle, the illuminated graphical image 17*c* would then be viewable when looking toward the exterior side 10*a* of the receiving surface 10 (through the receiving surface 10).

In practice, the materials and components introduced in the general display device 11 of FIGS. 1A and 1B could be comprised of, but not limited to, the following:

(a) The flexible substrate 12 would ideally be comprised of a sheet of releasably-adherent material, such as static-cling film, cohesive film, releasable-adhesive sheeting, and the like. Alternatively, the flexible substrate 12 may consist of one or more layers of a similar flexible material, such as mylar, vinyl, and the like, that ultimately provides at least one exposed releasably-adherent surface 12*a*. For applications where the graphical image 17*c* is meant to be viewed through the receiving surface 10, at least a portion of the flexible substrate 12, particularly that which is coincident with the introduced graphical component 17*c*, would normally be transparent. Furthermore, the releasably-adherent flexible substrate 12 may be a printable material that could accept a printed image that may be used instead of, or in addition to, the introduced graphical component 17*b* and graphical image 17*c*.

(b) The discrete components 13-17 may be mounted to the flexible substrate 12 using commonly-known adhesion materials, such as an applied adhesive, double-stick tape, static-cling or cohesive film, and the like. Alternatively, the discrete components 13-17 may be mounted using a heat-staking process or similar method. Furthermore, these same mounting techniques may be used for joining the individual components of a combinational component, such as the image-generating component 17.

Figure 2:
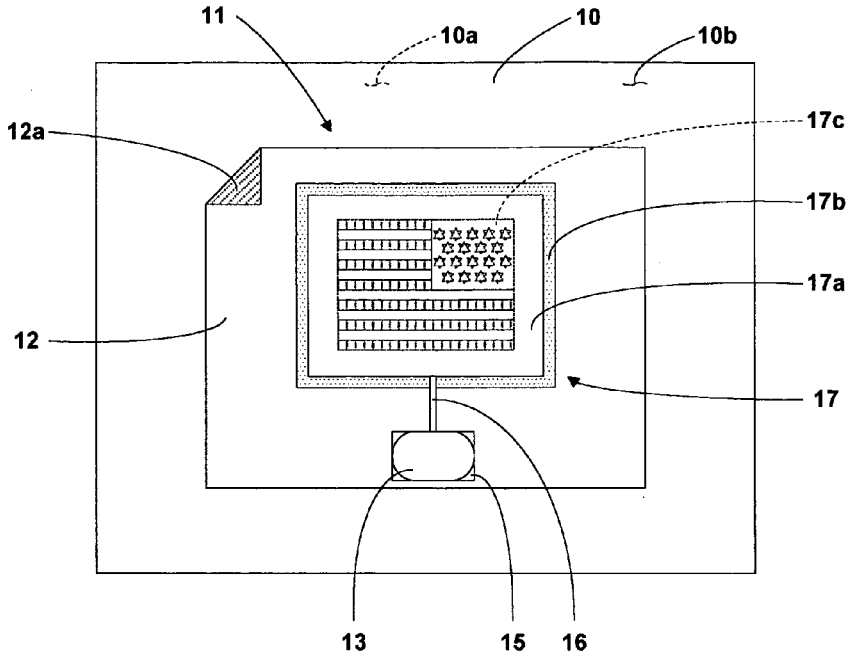
FIG. 2 shows a modified version of the display device of FIG. 1A with further combined components.

(c) The energy component 13 may be comprised of at least one energy generating device, such as a solar cell, battery, power supply, and the like. The device could be mounted to the flexible substrate 12 either directly or while contained within a small chassis and/or case. Furthermore, although the energy component 13 is shown as a separate component, in actuality at least a portion of it may be combined with the control-circuit component 15 as shown in FIG. 2.

Figure 3:
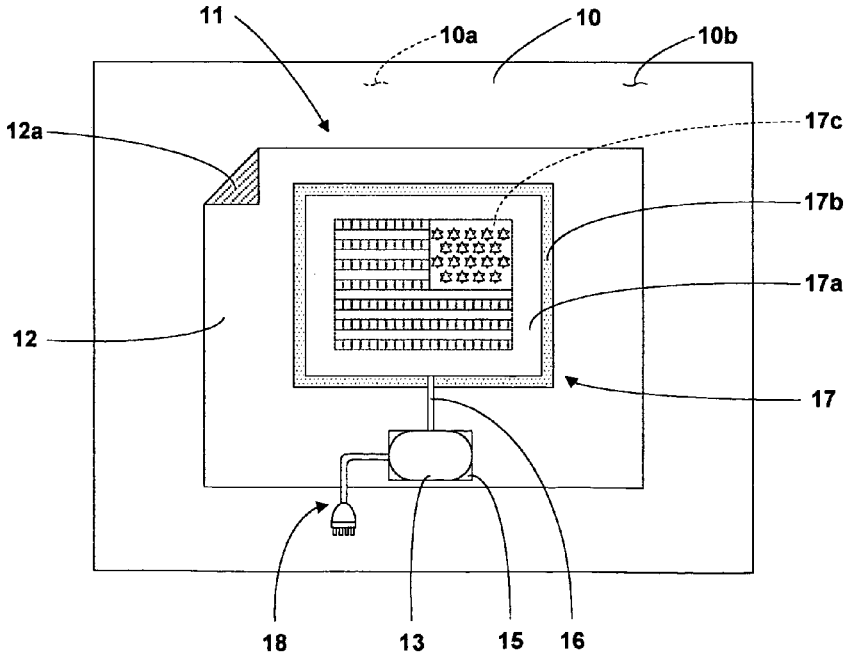
FIG. 3 shows a modified version of the display device of FIG. 2 with an optional interface component.

(d) The conducting components 14 and 16 may be comprised of various types of conductive devices, such as wires, circuit board traces, conductive printings, and the like. Conductive printings could conceivably be printed directly upon the flexible substrate 12. Although conducting component 14 and conducting component 16 are shown to be separate components, in actuality they may be combined into a single conducting component, such as a cable, harness, multi-trace circuit board, and the like. Furthermore, it may be desirable in some applications for the display device 11 to incorporate an interface component 18, such as the connector assembly shown in FIG. 3, in order to communicate power, control, and/or data signals from an external source to at least one of the discrete components 13-17.

(e) The control-circuit component 15 may be comprised of various types of circuitry, such as that used to control power, logic, and/or data related functions. Such functions may include rectification, power conversion, power regulation, sequencing, timing, logic operations, data processing, wireless communication and the like. The circuitry may be in the form of a readily available off-the-shelf device and/or a custom assembly of discrete devices mounted to a circuit board. The circuitry could be mounted to the flexible substrate 12 either directly or while contained within a small chassis and/or case. Furthermore, although the control-circuit component 15 is shown as a separate component, in actuality at least a portion of it may be combined with the energy component 13 as shown in FIG. 2.

(f) The illuminating component 17*a* associated with the image-generating component 17 would ideally be comprised of a flexible electroluminescent material, but could also be comprised of other types of light-generating devices, such as light emitting diodes, incandescent lamps, fiber optics, and the like. The graphical component 17*b* associated with the image-generating component 17 may be comprised of various types of medium used to support and/or provide a graphical image 17*c*. Such medium may include printable sheet material, pre-printed material, static-cling or cohesive film, shaped objects, and the like. In some instances, such as with shaped objects, the shape of the graphical component 17*b* itself may act as the graphical image 17*c*. In other instances, such as with printable sheet material, the graphical image 17*c* would be applied or affixed to the graphical component 17*b*. The illuminating component 17*a* and the graphical component 17*b* may be joined together using the same methods discussed for mounting the discrete components 13-17 to the flexible substrate 12. Furthermore, if the flexible substrate 12 is a printable material, as discussed in item (a) above, an image printed upon the flexible substrate 12 may be used instead of, or in addition to, the graphical component 17*b* and graphical image 17*c*.

(g) The type of receiving surface 10 to which the display device 11 is mounted would depend on the particular application. In applications such as the display device 11 of FIGS. 1A and 1B, a transparent receiving surface 10, such as a window of a vehicle or building, would be used in order to make the graphical image 17*c* viewable when looking through the receiving surface 10. In general, a transparent receiving surface, such as clear glass, lexan, or plexiglass, would normally be used in applications where at least one graphical image is to be made viewable when looking through a receiving surface.

Figure 4:
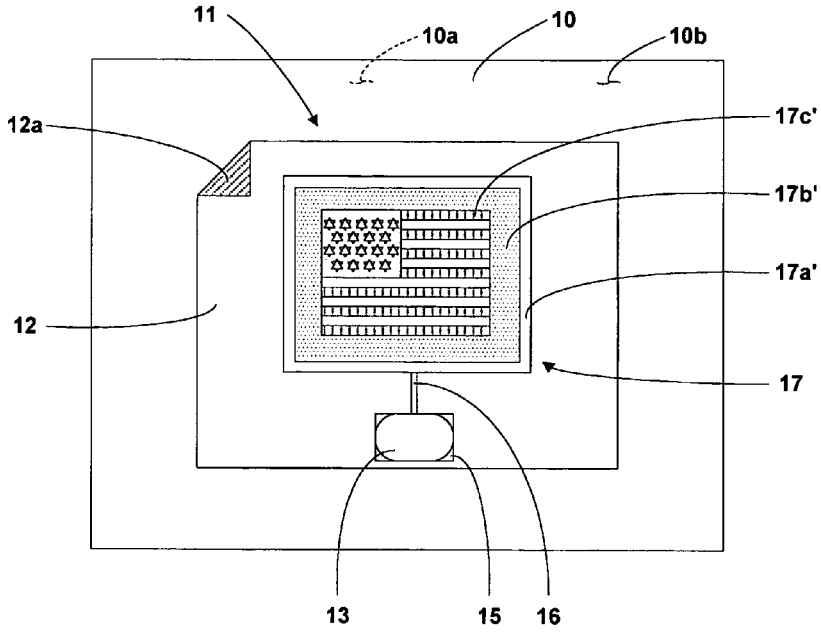
FIG. 4 shows a display device with an interior-facing graphical image.

Referring to FIG. 4, a display device 11 is shown to have an image-generating component 17 that is comprised of an interior-facing illuminating component 17*a*' and an interior-facing graphical component 17*b*'. The graphical component 17*b*' is shown to include an interior-facing graphical image 17*c*'. Unlike the device of FIG. 1A, the components of the image-generating device 17 are oriented so that the graphical image 17*c*' is viewable when looking toward the interior side 10*b* of the receiving surface 10 (not through the receiving surface 10). Otherwise, the construction techniques and operation of this display device 11 would be similar to that of FIG. 1A. In this application, since the graphical image 17*c*' is not viewable through the receiving surface 10, the flexible substrate 12 and receiving surface 10 would not necessarily need to be comprised of transparent materials. The receiving surface 10 could be any smooth surface, transparent or opaque, such as glass, ceramic, plastic, metal, or other similar material.

Figure 5:
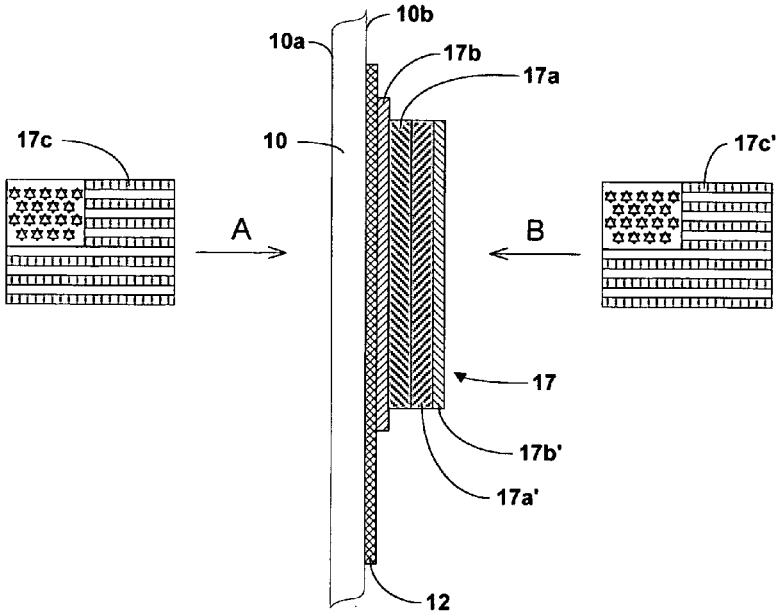
FIG. 5 shows a partial side view of a display device with bi-directional graphical images.

Referring to FIG. 5, a partial side view is shown of a display device 11 having an image-generating component 17 with both exterior-facing and interior-facing components, allowing a bi-directional image to be displayed. In particular, the image-generating component 17, which is mounted to the flexible substrate 12, is shown to be sequentially comprised of an exterior-facing graphical component 17*b*, an exterior-facing illuminating component 17*a*, an interior-facing illuminating component 17*a*', and an interior-facing graphical component 17*b*'. The components are oriented so that an exterior-facing graphical image 17*c*, integral to graphical component 17*b*, is viewable when looking through the receiving surface 10 (in the direction of arrow A), while an interior-facing graphical image 17*c*', integral to graphical component 17*b*', is viewable when looking toward the interior side 10*b* of the receiving surface 10 (in the direction of arrow B). The construction techniques and operation of this display device 11, including the techniques used to construct the multi-layered image-generating component 17, would be similar to that of FIG. 1A and FIG. 4. Depending on the application, the energy component 13 and/or control-circuit component 15 (both not shown) could be configured to either independently or simultaneously activate the illuminating components 17*a* and 17*a*'. When independently activated, at least one of the illuminating components 17*a* and 17*a*' would normally include an opaque backing to keep the light sources from interacting. When simultaneously activated, the illuminating components 17*a* and 17*a*' could actually be replaced by a single illuminating component that is capable of providing bi-directional light. Furthermore, although the graphical images 17*c* and 17*c*' are shown to display the same image, in actuality different images could be displayed. For example, if the display device 11 was mounted to an inside window of a business entrance, the illuminated exterior-facing graphical image 17*c* could display the message "Welcome", while the illuminated interior-facing graphical image 17*c*' could display the message "Come Again".

Figure 6A:
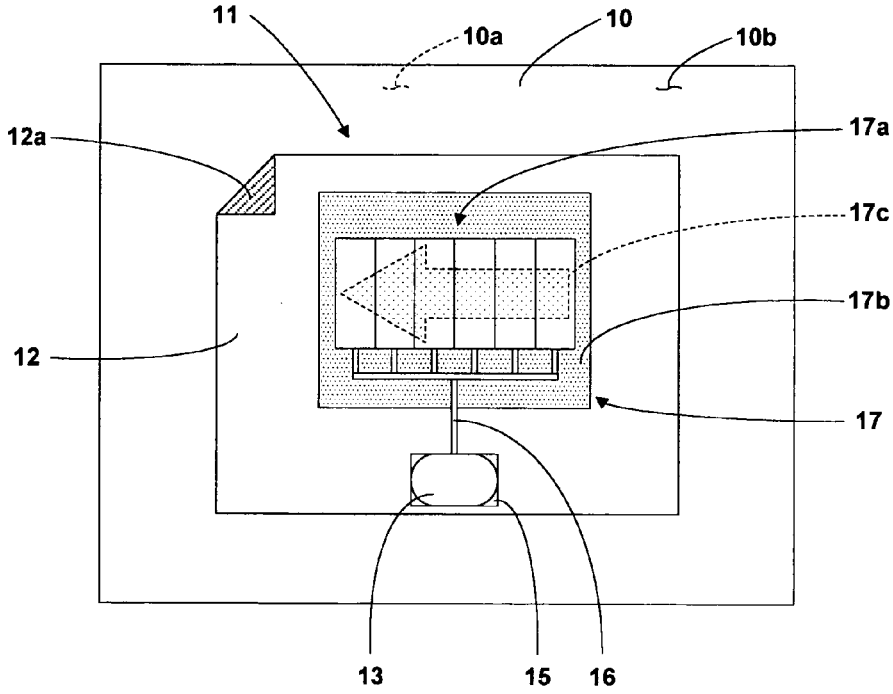
FIG. 6A shows the rear view of a display device with a plurality of illuminating components.
Figure 6B:
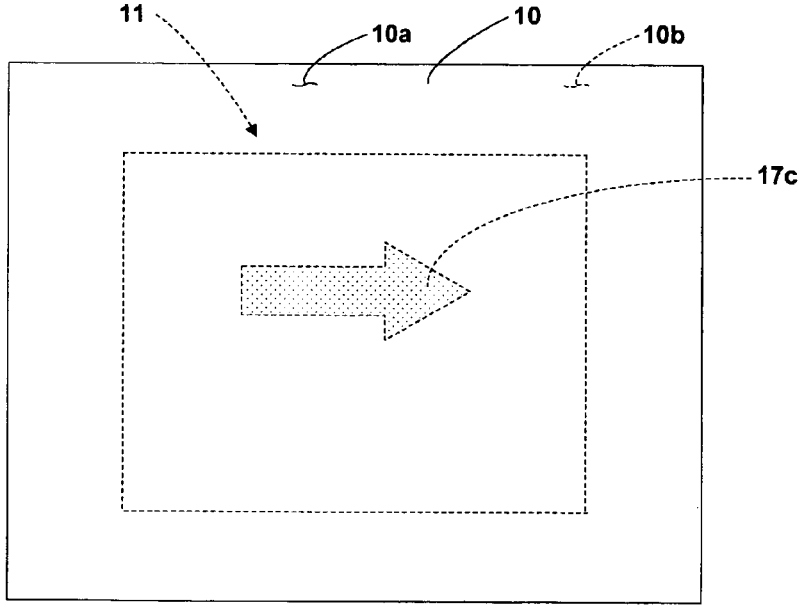
FIG. 6B shows the front view of the display device of FIG. 6A as viewed through a transparent receiving surface.

Referring to FIG. 6A, the image-generating component 17 of a display device 11 is shown to include a plurality of exterior-facing illuminating components 17*a*, an exterior-facing graphical component 17*b*, and an exterior-facing graphical image 17*c*. Depending on the application, the energy component 13 and/or control-circuit component 15 could be configured to either independently, simultaneously, or sequentially activate the plurality of illuminating components 17*a*. Referring to FIG. 6B, the graphical image 17*c* is shown to be a right-pointing directional arrow that is made viewable when looking toward the exterior side 10*a* of a transparent receiving surface 10 (through the receiving surface 10). In this example, the directional arrow could be used to draw attention to a particular item, direct traffic, or perform a similar function. In the case where the plurality of illuminating components 17*a* are sequentially activated, the directional arrow could appear to be in motion. Otherwise, the construction techniques and operation of the display device 11 would be similar to those previously discussed. Furthermore, similar to FIG. 4, the image-generating component 17 could actually be comprised of interior-facing components, so as to make the directional arrow viewable when looking toward the interior side 10*b* of the receiving surface 10.

Figure 7:
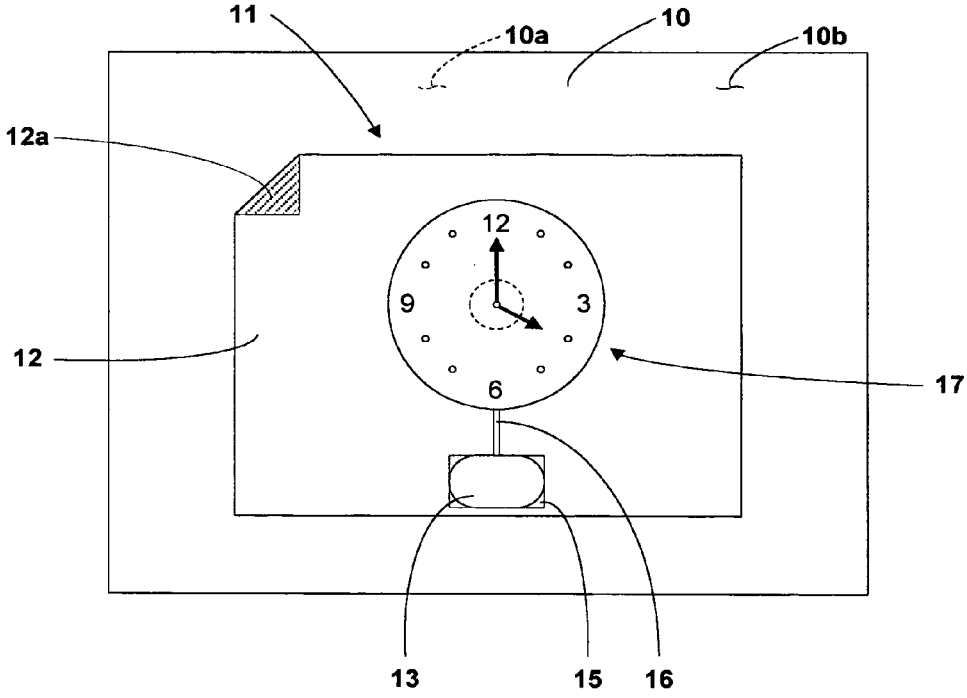
FIG. 7 shows a display device with an image-generating component comprised of an electromechanical apparatus.
Figure 8:
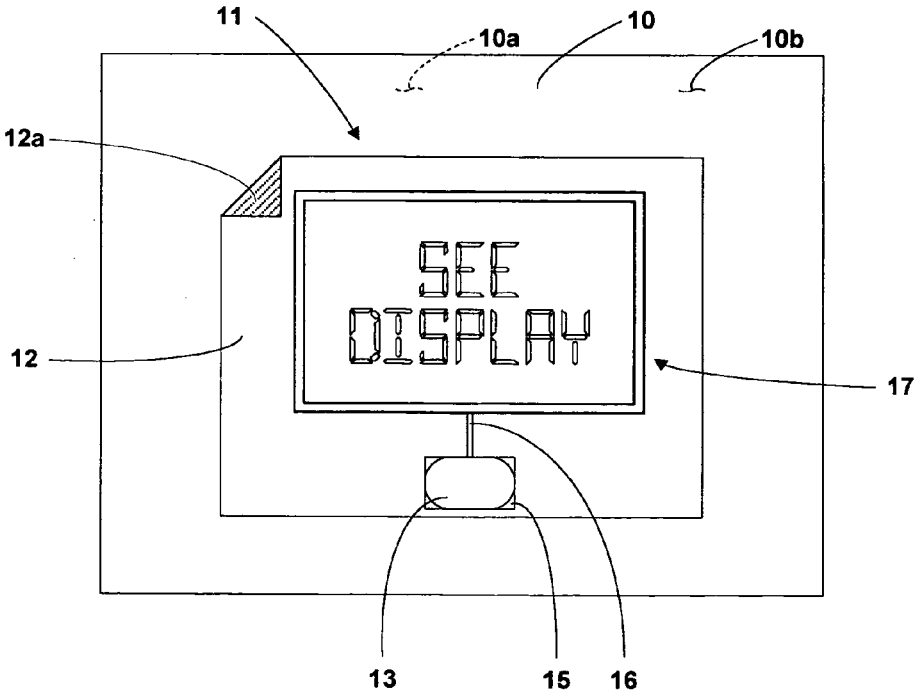
FIG. 8 shows a display device with an image-generating component comprised of an electrical apparatus.

Although the image generating component has thus far been introduced as being comprised of illuminating components and graphical components, in actuality it could be comprised of various other types of electrical, mechanical, and/or electromechanical devices, such as the examples shown in FIG. 7 and FIG. 8.

Referring to FIG. 7, the image-generating component 17 of a display device 11 is shown to be comprised of an electromechanical apparatus, such as an analog clock. Referring to FIG. 8, the image-generating component 17 of a display device 11 is shown to be comprised of an electrical apparatus, such as a digital display monitor. In each case, the apparatus could be powered and/or controlled by the energy component 13 and/or control-circuit component 15 through conducting component 16, or it could be powered and/or controlled by its own self-contained components. Although the apparatus is shown to be viewable when looking toward the interior side 10*b* of the receiving surface 10, in actuality it could be made viewable when looking toward the exterior side 10*a* of the receiving surface 10 (through the receiving surface 10), depending on the construction of its facade. The transparent or opaque properties of the receiving surface 10 and the releasably-adherent flexible substrate 12 would depend on the desired viewing direction. The actual type of apparatus used for the image-generating component 17 of the display device 11 would depend on the application. Furthermore, it may be desirable in some applications for the display device 11 to incorporate the interface component 18 of FIG. 3 in order to communicate power, control, and/or data signals from an external source to at least one of the discrete components 13-17, including the electromechanical or electrical apparatus.

As previously mentioned, the type, location, and quantity of discrete components incorporated within a display device of the present invention can vary depending on the application. Since the display device utilizes a customizable flexible substrate instead of a housing or frame to contain the discrete components, the size and shape of the display device is not reasonably restricted. The free-form approach to constructing the display device allows it to be adapted to receiving surfaces of various sizes and shapes. Furthermore, the amount of surface area provided by the releasably-adherent flexible substrate allows the display device to physically support a plurality of discrete components, including components that are substantially three dimensional.

SUMMARY AND SCOPE

Accordingly, the reader will see that the present invention is a new and improved display device that can be releasably mounted to a receiving surface such as glass, ceramic, metal, plastic, or other similar material. The display device comprises various discrete components that are integrated upon a flexible substrate. One surface of the flexible substrate is used to mount the various discrete components, while the remaining surface of the flexible substrate comprises releasable adhering properties that allow the device to be releasably mounted to the receiving surface. The various discrete components of the device have electrical, mechanical, graphical, and/or combinational properties which cooperate to provide a visual display. The visual display, which can be made viewable when looking toward the exterior and/or interior side of the receiving surface, can be generated using a wide variety of image-generating components. Furthermore, the reader will see that the present invention is ideally suited for business signs, residential signs, novelty signs, vehicle signs, advertisements, holiday decorations, and numerous other applications.

Although the description of the present invention contains many specificities, these should only be construed as an illustration of the presently preferred embodiment of the invention, and not a limitation of the spirit and scope of the invention. Accordingly, many variations may become apparent to one skilled in the art. Therefore, the scope of the present invention should be determined by the attached claims and their legal equivalents, rather than be limited to the specific examples given.

We claim:

1. A flexible releasably-mounted display device for mounting to an external receiving surface, said display device comprising:

a) a flexible substrate having an interior-facing surface and an exterior-facing surface;

b) one or more discrete components adherably mounted to said interior-facing surface of said flexible substrate, said one or more discrete components comprising properties that cooperate to generate at least one viewable image;

c) releasable adhering means having static-cling properties and being disposed on said exterior-facing surface of said flexible substrate so that said flexible substrate can be releasably mounted to said external receiving surface; and d) at least one of said one or more discrete components comprises illuminating properties, whereby, said display device is releasably mounted to said external receiving surface by static cling so that said at least one viewable image is made viewable when looking toward at least one side of said external receiving surface.

2. The display device of claim 1 wherein at least a portion of said flexible substrate is not transparent.

3. The display device of claim 1 wherein at least a portion of said flexible substrate is a printable material.

4. The display device of claim 1 wherein at least one of said one or more discrete components is substantially three dimensional.

5. The display device of claim 1 wherein said at least one viewable image is oriented so as to be viewable when looking through said external receiving surface, wherein at least a portion of said external receiving surface is transparent.

6. The display device of claim 1 wherein said at least one viewable image is oriented so as to be viewable when looking toward the same side of said external receiving surface to which said display device is mounted.

7. The display device of claim 1 wherein said at least one viewable image is unidirectionally viewable.

8. The display device of claim 1 wherein said at least one viewable image is bi-directionally viewable.

9. A flexible releasably-mounted display device for mounting to an external receiving surface, said display device comprising:

a) a flexible substrate having an interior-facing surface and an exterior-facing surface, said exterior-facing surface comprising releasable adhering means so that said flexible substrate can be releasably mounted to said external receiving surface, said releasable adhering means comprises a releasable static cling; and b) one or more discrete components adherably mounted to said interior-facing surface of said flexible substrate, said one or more discrete components comprising image-generating means to produce at least one illuminated viewable image;

whereby said display device is releasably mounted to said external receiving surface by static cling so that said at least one viewable image is made viewable when looking toward at least one side of said receiving surface.

10. The display device of claim 9 wherein at least one of said one or more discrete components is substantially three dimensional.

11. The display device of claim 9 wherein at least one of said one or more discrete components comprises electrical properties.

12. The display device of claim 9 wherein at least one of said one or more discrete components depict motion.

13. An illuminated display device comprising a flexible sheet of static-cling film having a contacting face and an opposing face, the flexible sheet comprising a non-opaque portion with an illuminating component disposed on the flexible sheet, a power unit coupled to the illuminating component, the contacting face releasably adhering to an external receiving surface by static cling, and the power unit energizing the illuminating unit.

14. The display device of claim 13 wherein the power unit selectively energizes the illuminating unit.

15. The display device of claim 13 wherein the at least one illuminating component is fixed to the flexible sheet.

16. The display device of claim 13 wherein the illuminating component is mounted to the flexible sheet by heatstaking.

17. The display device of claim 13 wherein a second illuminating component is disposed on the flexible sheet;

the power unit coupled to the second illuminating component; and the second illuminating component energized independently of the at least one illuminating component.

18. The display device of claim 13 wherein the at least one illuminating component includes at last two regions, at least one of the at last two regions illuminated separately from an other of the at last two regions.

19. The display device of claim 13 wherein a second illuminating component is disposed on the flexible sheet, the second illuminating component optically isolated from the at least one illuminating component;

the at last one illuminating component displaying a first image, and the second illuminating component displaying a second image.

20. An illuminated display device, comprising:

a flexible static cling sheet for mounting the device to a window by static cling;

a light source mounted to the sheet; and a power source operatively connected to the light source to provide electrical power to illuminate at least a portion of the sheet.

21. The illuminated display device of claim 20 wherein the sheet has an outer surface for engaging the window and an inner surface to which the light source is mounted.

22. The illuminated display device of claim 20 wherein the sheet is clear.

* * * * *